US005577835A

United States Patent [19]

Huang

[11] Patent Number: 5,577,835

[45] Date of Patent: Nov. 26, 1996

[54] PL LAMP HOLDER

[76] Inventor: Peter Huang, 3F, No. 570, Sec. 7, Chung Hsiao E. Rd., Taipei, Taiwan

[21] Appl. No.: 379,196

[22] Filed: Jan. 24, 1995

[51] Int. Cl.[6] ..... F21V 11/00

[52] U.S. Cl. ..... 362/353; 362/216; 362/226; 362/363

[58] Field of Search ..... 362/226, 216, 362/260, 351, 353, 363

[56] References Cited

U.S. PATENT DOCUMENTS 4,750,096 6/1988 Lim ..... 362/260 X 5,015,917 5/1991 Nigg ..... 362/216 X 5,189,339 2/1993 Peshak ..... 362/216 X 5,428,515 6/1995 Jung ..... 362/216 X

*Primary Examiner*—Stephen F. Husar

[57] ABSTRACT

A PL lamp holder including a holder shell coupled with a base, a holder mount detachably fastened to the holder shell by hooks to hold down a starter circuit and having a crossed slot and a fuse mounted on a partition plate in the crossed slot, a holder body detachably fastened to the holder mount through a swivel joint to hold a capacitor, which is electrically connected to the starter circuit when the holder body and the holder mount are firmly fastened together.

4 Claims, 5 Drawing Sheets

PL LAMP HOLDER

BACKGROUND OF THE INVENTION

The present invention relates to PL lamp holders, and relates more particularly to an improved structure of PL lamp (parallel fluorescent tubes lamp) holder which is detachable so that all the components can be replaced separately when damaged.

FIG. 1 shows a PL lamp holder according to the prior art. This structure of PL lamp holder comprises a holder body B to hold two lamp tubes A, and a holder shell E fastened to the holder body B. The holder body B has a starter C on the inside. The power input terminals D1 and D2 of the starter C are respectively inserted into two round holes (not shown) on the holder shell E. This structure of PL lamp holder has drawbacks as outlined hereinafter.

1) The connection between the holder body B and the holder shell E is not stable, and an electric contact error tends to happen.
2) Because the lamp tubes are fixedly fastened to the holder body, when the starter is damaged, the lamp tubes become useless.
3) When the PL lamp holder with the lamp tubes are thrown away, they will cause environmental pollutions.
4) The conventional starter cannot quickly start the lamp tubes and will cause the lamp tubes to flash when it is turned on, causing the service life of the lamp tubes shortened.
5) It is not easy to fasten the terminals of the starter to the round holes of the holder shell.

SUMMARY OF THE INVENTION

The present invention has been accomplished under the circumstances in view. It is one object of the present invention to provide a PL lamp holder which is easy to assemble. It is another object of the present invention to provide a PL lamp holder which is stable in use. It is still another object of the present invention to provide a PL lamp holder which is detachable so that the consumer can make a replacement easily when any electric component is damaged. It is still another object of the present invention to provide a PL lamp holder which does not cause a short circuit. It is still another object of the present invention to provide a PL lamp holder which is easy to assemble and inexpensive to manufacture.

According to one aspect of the present invention, the PL lamp holder comprises a holder shell coupled with a base, a holder mount detachably fastened to the holder shell by hooks to hold down a starter circuit and having a crossed slot and a fuse mounted on a partition plate in the crossed slot, a holder body detachably fastened to the holder mount through a swivel joint to hold a capacitor, which is electrically connected to the starter circuit when the holder body and the holder mount are firmly fastened together.

According to another aspect of the present invention, a fuse cover is fastened to the crossed slot of the holder mount to protect the fuse.

According to still another aspect of the present invention, a transparent lampshade is fastened to the toothed periphery of the holder body and covered over the lamp tubes.

DETAILED DESCRIPTION OF THE PREFERRED EMBODIMENTS

Figure 1:
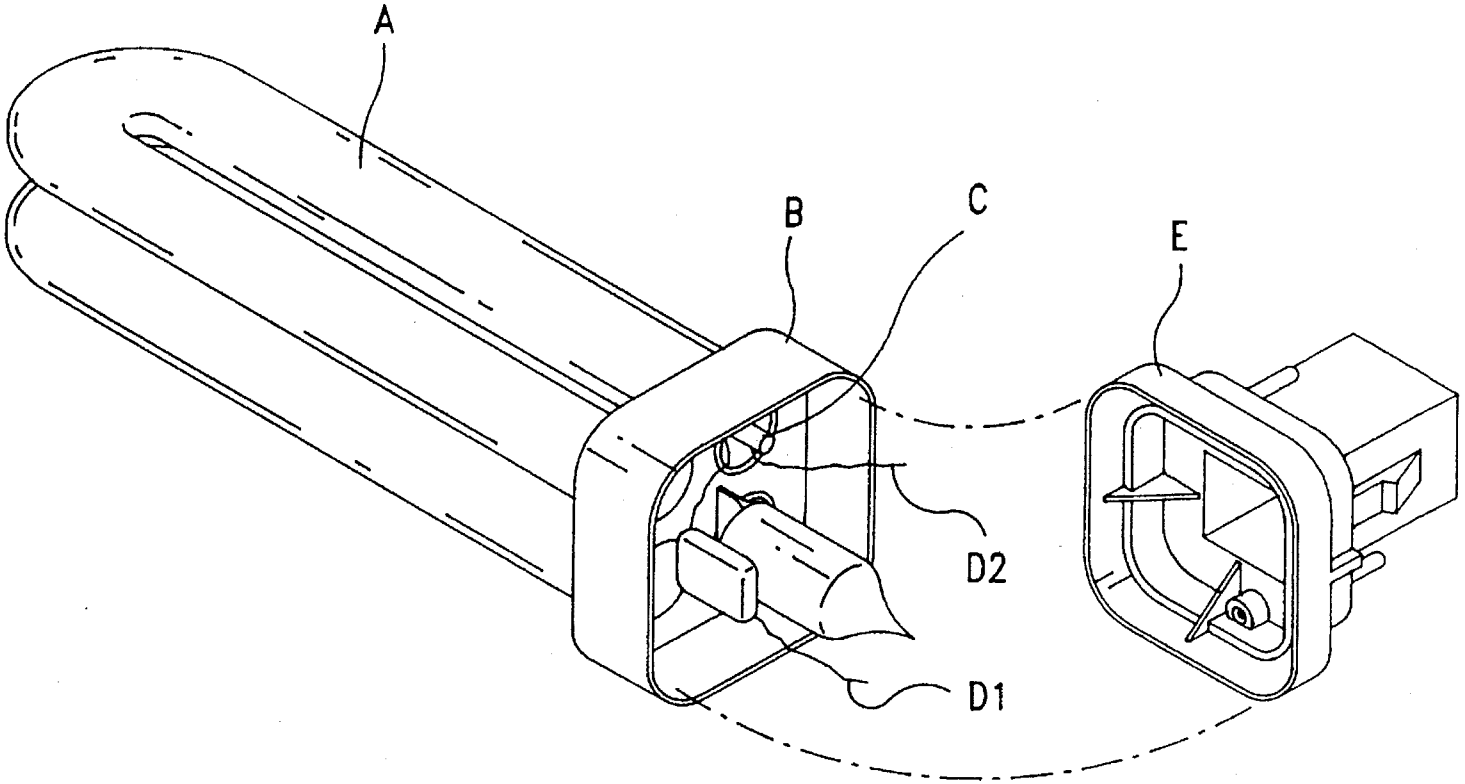
FIG. 1 (PRIOR ART)
FIG. 1 is an exploded view of a PL lamp holder according to the prior art.
Figure 2:
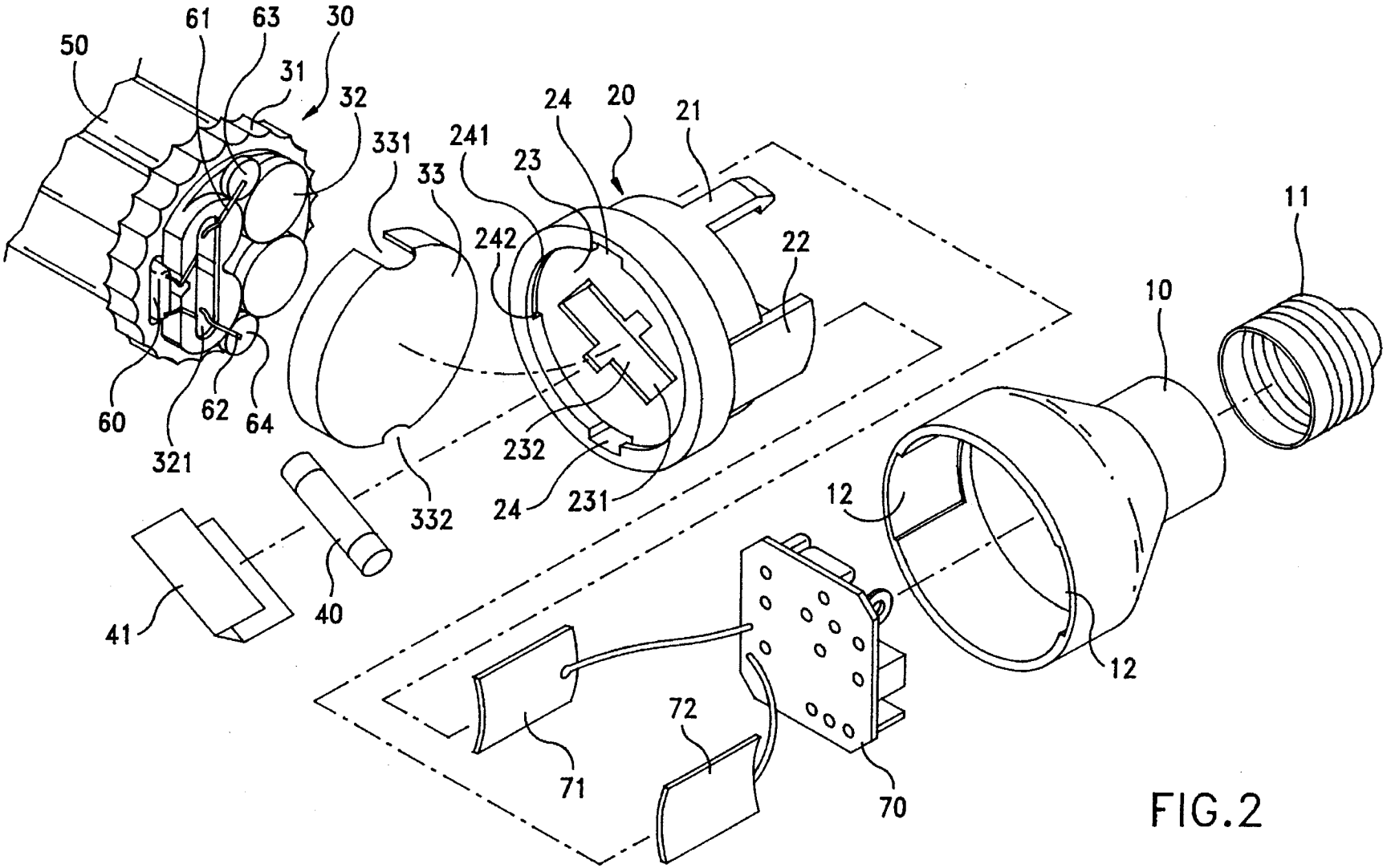
FIG. 2 is an exploded view of a PL lamp holder according to the present invention.
Figure 3:
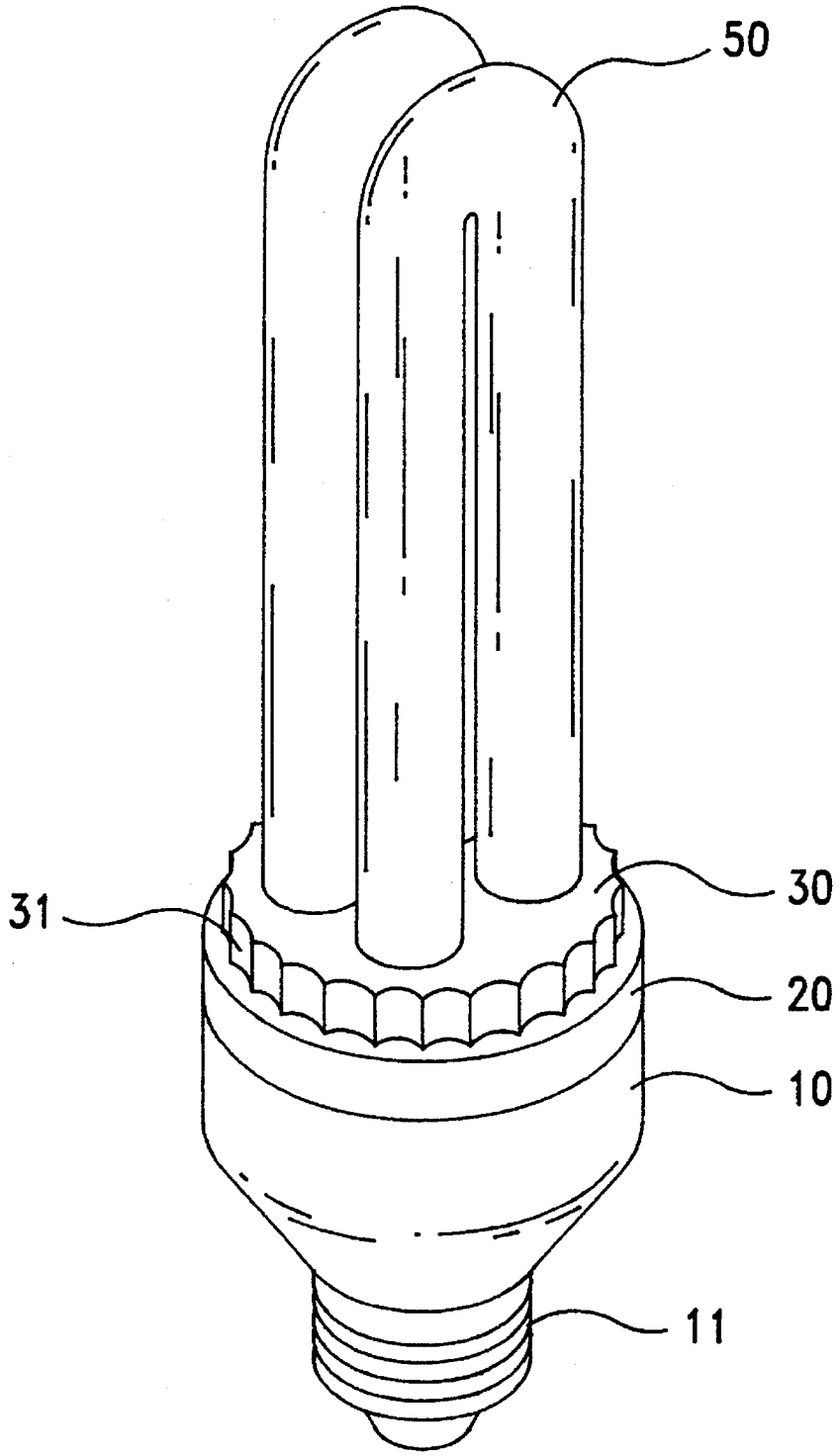
FIG. 3 is an elevational view of the PL lamp holder shown in FIG. 2.
Figure 4:
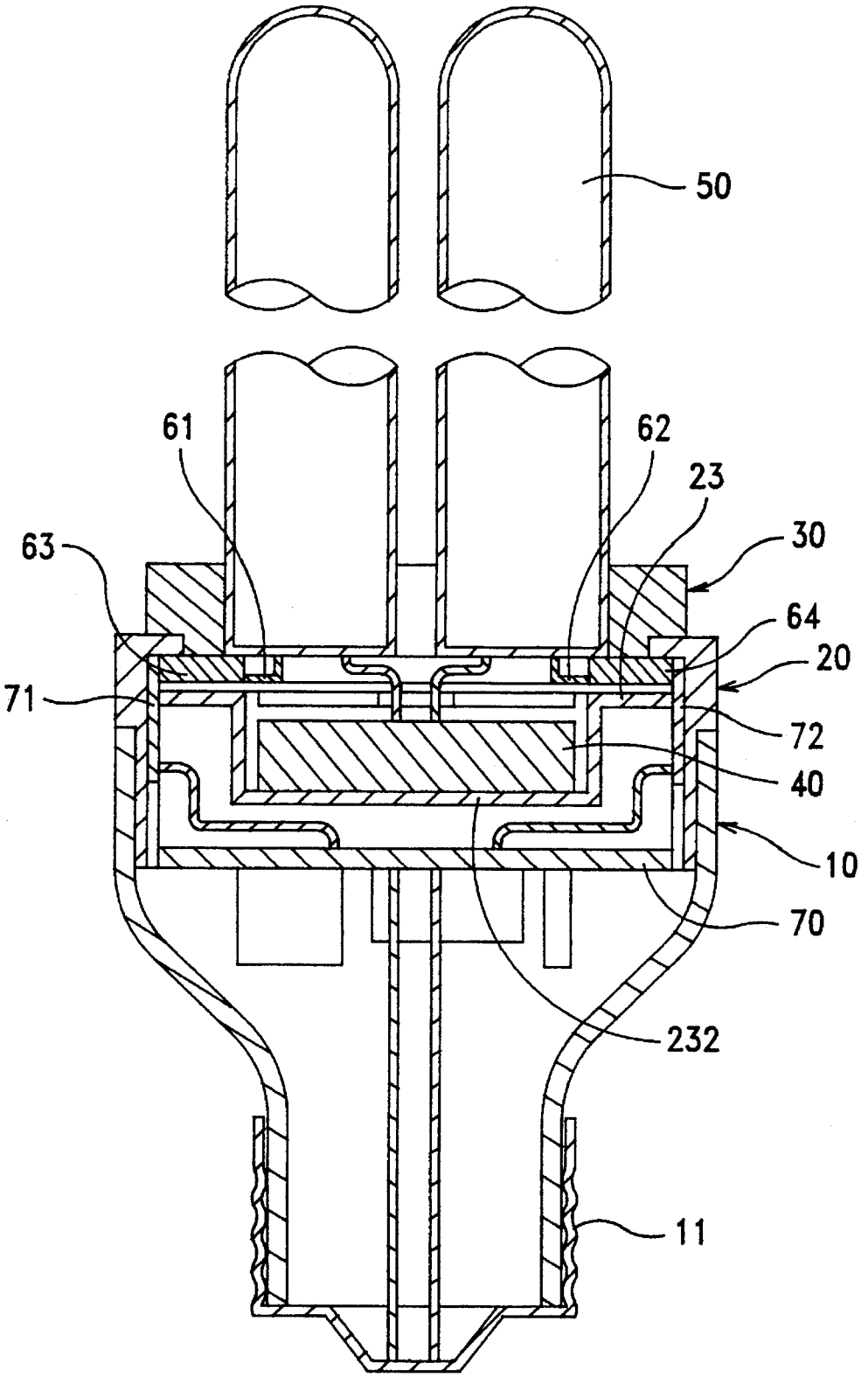
FIG. 4 is a longitudinal view in section of FIG. 3.

Referring to FIGS. 2, 3, and 4, a PL lamp holder in accordance with the present invention is generally comprised of a holder shell 10, a holder mount 20, and a holder body 30. The holder shell 10 is made of conical shape having a base 11 at the bottom for connection to a lamp socket, and a plurality of mounting grooves 12 on the inside of the top open end thereof for mounting the holder mount 20. The molder mount 20 comprises a plurality of downward hooks 21 and downward blocks 22 at the bottom fastened to the holder shell 10 (the downward blocks 22 are respectively inserted into the mounting grooves 12, and the downward hooks 21 are respectively hooked on the inside wall of the holder shell 10) to hold down an electronic starter circuit board 70, a top recess 23, a crossed slot 231 on the top recess 23, a partition plate 232 suspended from the crossed slot 231, a fuse 40 mounted on the partition plate 232, a fuse cover 41 fastened to the crossed slot 231 and covered over the fuse 40, two opposite longitudinal grooves 24 and two rectangular holes 242 alternatively spaced around the border of the top recess 23, two curved groove 241 extended from the longitudinal grooves 24 and terminating in the rectangular holes 242 respectively. The rectangular holes 242 receive two opposite contact metal plates 71 and 72 of the electronic starter circuit 7. The holder body 30 is made of circular shape, having a threaded portion 31 around the periphery, two sets of circular holes 32, which receive two parallel fluorescent lamp tubes 50, an elongated slot 321 through one circular hole 32, two opposite metal contacts 63 and 64 bilaterally disposed between the circular holes 32, a capacitor 60 having conductors 61 and 62 inserted through the elongated slot 321 and respectively welded to the two opposite metal contacts 63 and 64. By inserting the opposite metal contacts 63 and 64 into the longitudinal grooves 24 on the holder mount 20 and then turning the holder body 30 relative to the holder mount 20 to move the metal contacts 63 and 64 into the rectangular holes 242, the holder body 20 and the holder mount 20 are firmly connected together, and the metal contacts 63 and 64 are respectively electrically connected to the contact metal plates 71 and 72 of the electronic starter circuit 70. Through the toothed portion 31, the holder body 30 can be conveniently turned relative to the holder mount 20. When the lamp tubes 50, the fuse 40, or the electronic starter circuit 70 is damaged, the holder body 30 can be conveniently separated from the holder mount 20 to make a replacement. Furthermore, a cap 33 is covered on the holder body 30 and received within the top recess 23 of the holder mount 20, having two opposite openings 231 and 232 through which the metal contacts 63 and 64 of the holder body 30 protrude. When the PL lamp holder is assembled, the two opposite power input terminals of the electronic starter circuit 70 are respectively connected to the ring contact and tip contact of the base 11.

Figure 5:
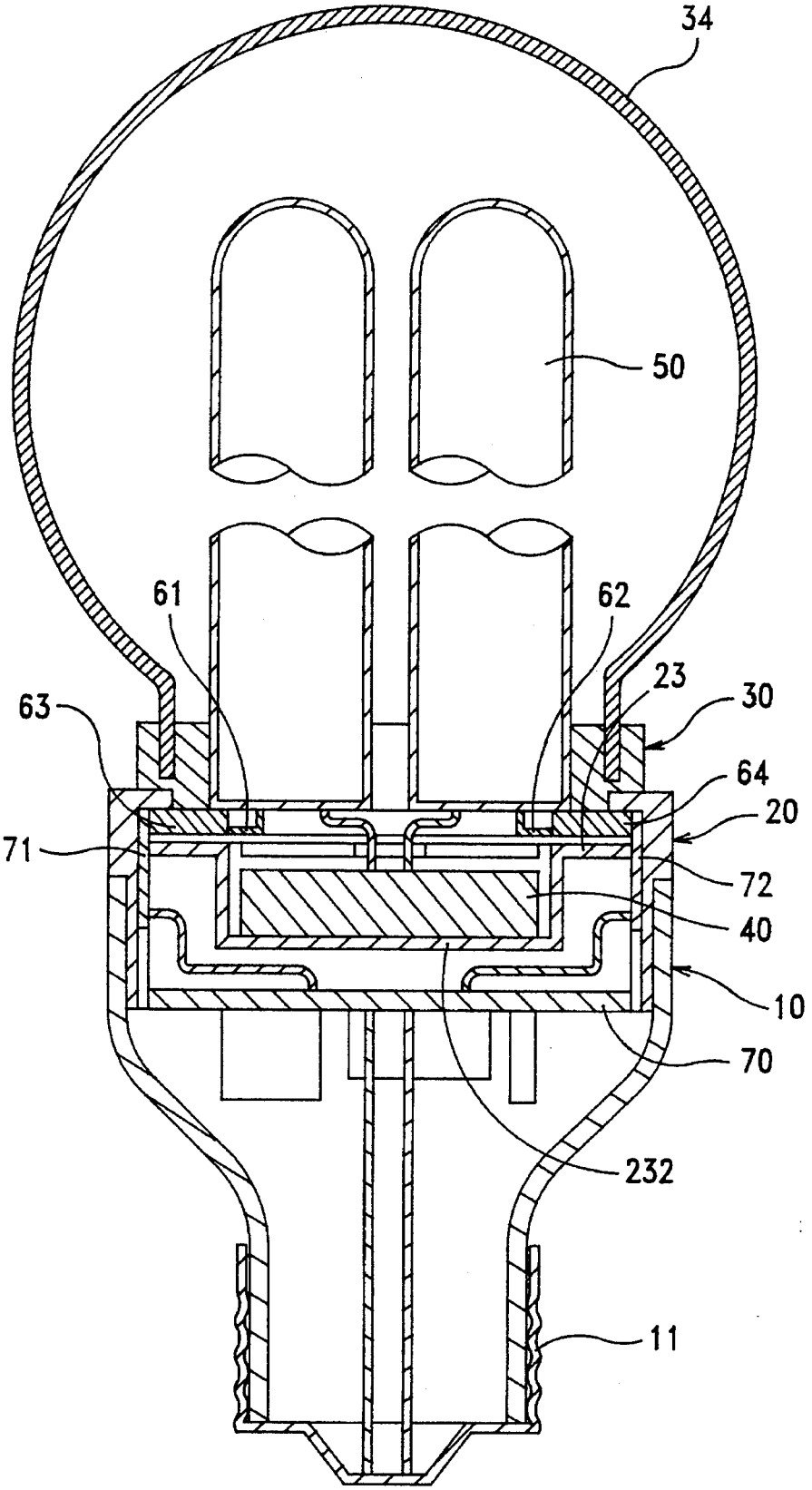
FIG. 5 shows an alternate form of the PL lamp holder of the present invention.

Referring to FIG. 5, a transparent lampshade 34 can be fastened to the toothed portion 31 of the holder body 30 and covered over the lamp tubes 50.

While only one embodiment of the present invention has been shown and described, it will be understood that various modifications and changes could be made without departing from the spirit and scope of the invention.

What is claimed is:

1. A PL lamp holder comprising:

a holder shell made of conical shape having a base at one end for connection to a lamp socket, a top open end, and a plurality of mounting grooves inside said top open end;

a holder mount fastened to said top open end of said holder shell to hold down an electric starter circuit, said holder mount comprising a plurality of downward blocks respectively inserted into said mounting grooves on said top open end of said holder shell, a plurality of downward blocks inserted into said top open end of said holder shell and hooked on an inside wall of said holder shell, a top recess, a crossed slot on said top recess, a partition plate suspended from said crossed slot, a fuse mounted on said partition plate, two opposite longitudinal grooves and two rectangular holes alternatively spaced around said top recess, two curved grooves extended from said longitudinal grooves and terminating in said rectangular holes respectively, said electronic starter circuit having two input terminals respectively connected to said base of said holder shell and two output terminals respectively connected to two contact metal plates disposed in said rectangular holes;

a holder body fastened to said holder mount, said holder body comprising a threaded portion around the periphery, two sets of circular holes, which receive two parallel fluorescent lamp tubes, an elongated slot through one circular hole, two opposite metal contacts disposed in contact with said contact metal plates of said electronic starter circuit, a capacitor having two conductors at two opposite ends respectively inserted through the elongated slot on said holder body and welded to said metal contacts of said holder body; and wherein by inserting said opposite metal contacts of said holder body into said longitudinal grooves on said holder mount and then turning said holder body relative to said holder mount to move said metal contacts of said holder body into said rectangular holes on said holder body, said holder body and said holder mount are firmly connected together, and said metal contacts of said holder body are respectively electrically connected to said contact metal plates of said electronic starter circuit.

2. The PL lamp holder of claim 1 wherein said holder mount further comprises a fuse cover fastened to said crossed slot and covered over said fuse.

3. The PL lamp holder of claim 1 wherein said holder body is covered with a cap, said cap being received within said top recess of said holder mount and having two opposite openings through which said metal contacts of said holder body protrude.

4. The PL lamp holder of claim 1 further comprises a transparent lampshade fastened to said threaded portion of said holder body.

* * * * *